United States Patent [19]

Nishizima et al.

[11] Patent Number: 4,540,656

[45] Date of Patent: Sep. 10, 1985

[54] COLOR PHOTOGRAPHIC LIGHT-SENSITIVE MATERIAL

[75] Inventors: Toyoki Nishizima; Masao Sasaki; Kaoru Onodera, all of Odawara, Japan

[73] Assignee: Konishiroku Photo Industry Co., Ltd., Tokyo, Japan

[21] Appl. No.: 499,315

[22] Filed: May 27, 1983

[30] Foreign Application Priority Data

Jun. 1, 1982 [JP] Japan ..... 57-93323

[51] Int. Cl.[3] ..... G03C 1/46

[52] U.S. Cl. ..... 430/505; 430/507; 430/512; 430/538

[58] Field of Search ..... 430/512, 524, 538, 507, 430/505

[56] References Cited

U.S. PATENT DOCUMENTS

| | | | |
|---|---|---|---|
| 3,698,907 | 10/1972 | Sato et al. | 430/512 |
| 3,705,805 | 12/1972 | Nittel et al. | 430/512 |
| 3,794,493 | 2/1974 | Sobel et al. | 430/512 |
| 4,220,711 | 9/1980 | Nakamura et al. | 430/512 |

*Primary Examiner*—J. Travis Brown

*Attorney, Agent, or Firm*—Finnegan, Henderson, Farabow, Garrett & Dunner

[57] ABSTRACT

A color photographic light-sensitive material comprising, on a reflective support, at least one light-sensitive silver halide emulsion layer containing a dye-forming coupler and a non-light-sensitive layer provided on the light-sensitive silver halide emulsion layer, located furthest from the reflective support, the non-light-sensitive layer containing:

(a) a benzotriazole derivative represented by the following formula (I):

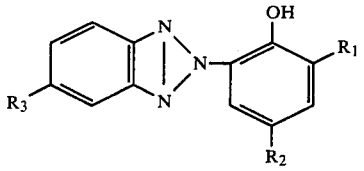

wherein $R_1$ and $R_2$ independently represent an alkyl, an alkoxy, an alkenyl, each alkyl, alkoxy, or alkenyl having not less than 4 carbon atoms, an aryl, or an aryloxy, said aryl and aryloxy each being substituted or unsubstituted and wherein $R_3$ represents hydrogen, a halogen, an alkyl, an alkoxy, an alkenyl, each alkyl, alkoxy, or alkenyl having not less than 4 carbon atoms, an aryl, or an aryloxy; and (b) at least one compound having selected from the formulae (II) or (III):

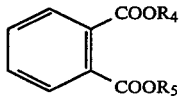

Formula (II)

wherein $R_4$ and $R_5$ independently represent an alkyl, having not less than 5 carbon atoms, an aryl, or an aralkyl, said aryl and aryloxy each being substituted or unsubstituted;

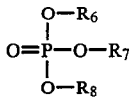

Formula (III)

wherein $R_6$, $R_7$ and $R_8$ independently represent an alkyl having not less than 5 carbon atoms.

11 Claims, No Drawings

COLOR PHOTOGRAPHIC LIGHT-SENSITIVE MATERIAL

BACKGROUND OF THE INVENTION

1. Field of the invention

This invention relates to color photographic light-sensitive materials in which a color image can be formed in a color-development process applied after the material is exposed to light, and more particularly to the constitution and composites of the photographic layers of the aforementioned color photographic light-sensitive material.

2. Description of the state of the art

Heretofore, it has so far been known that conventional color photographic light-sensitive materials for photographic printing use are generally formed by coating on a reflective support in order from the support side an yellow coupler-containing blue-sensitive silver halide emulsion layer, a non-light-sensitive first interlayer, a magenta coupler-containing green-sensitive silver halide emulsion layer, a non-light-sensitive second interlayer, a cyan coupler-containing red-sensitive silver halide emulsion layer and a non-light-sensitive protective layer.

And, particularly, in order to improve the resistance to light of the dye image formed from these couplers, an ultraviolet absorbing agent is dissolved into a high-boiling solvent to be added to the second interlayer.

However, even in this case, the resistance to light of the dye image formed from these couplers are still insufficient, leading to a considerable discoloration of the image by light.

In order to further reduce such discoloration, an ultraviolet absorbing agent should be added to the uppermost non-light-sensitive protective layer as well.

However, it has been found that the incorporation of an ultraviolet absorbing agent into the protective layer has the disadvantage that, particularly in the case of storing the print image under a high-temperature-high-humidity condition, the agent causes all the respective dyes of the image to be discolored.

This is considered due to the fact that the ultraviolet absorbing agent becomes deteriorated or vanished under a high-temperature-high-humidity condition.

OBJECT OF THE PRESENT INVENTION

As the present invention has been made in view of the situation described above, it is a primary object of the present invention to provide a color photographic light-sensitive material which is improved so that the respective dyes formed as an image on the material are not discolored during the storage thereof under a high-temperature-high-humidity condition.

BRIEF SUMMARY OF THE INVENTION

As a result of devoting ourselves to study for the object, it has now been found that the object of the present invention is accomplished by a combination of an ultraviolet absorbing agent and a high boiling solvent which are compatible with each other and which combination causes little discoloration of the dye image under a high-temperature-high-humidity condition, and thus the present invention has been established.

Namely, the present invention is of a color photographic light-sensitive material comprising a reflective support having thereon a plurality of silver halide emulsion layers of which the one located furthest from the support has a non-light-sensitive layer on the reverse side thereof to the support, the non-light-sensitive layer containing an ultraviolet absorbing agent having the following Formula [I] and a high boiling solvent having either the following Formula [II] or Formula [III]:

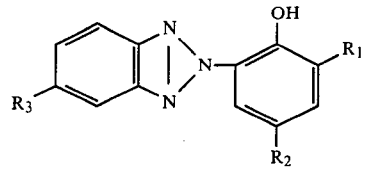

Formula [I]

wherein $R_1$ and $R_2$ each represents an alkyl, an aryl, an alkoxy, an aryloxy or an alkenyl radical, each having not less than 4 carbon atoms; and $R_3$ represents hydrogen, a halogen, an alkyl, an aryl, an alkoxy, an aryloxy or an alkenyl radical:

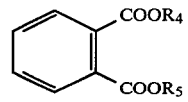

Formula [II]

wherein $R_4$ and $R_5$ each represents an alkyl radical having not less than 5 carbon atoms, an aryl or an aralkyl radical, wherein $R_4$ and $R_5$ may be either same or different:

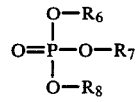

Formula [III]

wherein $R_6$, $R_7$ and $R_8$ each represents an alkyl radical having not less than 5 carbon atoms or an aryl radical, wherein $R_6$, $R_7$ and $R_8$ may be either same or different.

DETAILED DESCRIPTION OF THE INVENTION

The color photographic light-sensitive material of the present invention has a plurality of, namely, not less than two silver halide emulsion layers, and in an usual embodiment, has three different spectral sensitivity-having light-sensitive emulsion layers each containing appropriate one of non-diffusion yellow, magenta and cyan couplers, respectively.

The combinations of the light-sensitive silver halide emulsion layers with couplers used in this case are usually the red-sensitive silver halide emulsion layer with cyan coupler, the green-sensitive silver halide emulsion layer with magenta coupler, and the blue-sensitive silver halide emulsion layer with yellow coupler.

There are no special restrictions on coating order of these emulsion layers.

Usually, it is customary to coat in order from the reflective support side the yellow coupler-containing emulsion layer, the magenta coupler-containing emulsion layer, and the cyan coupler-containing emulsion layer. However, there may also be coated in the order of the magenta coupler-containing emulsion layer, the yellow coupler-containing emulsion layer and the cyan coupler-containing emulsion layer, or alternatively in another order: the cyan coupler-containing emulsion layer, the yellow coupler-containing emulsion layer, and then the magenta coupler-containing emulsion layer.

As the yellow, magenta and cyan couplers for use in the present invention, any known couplers may be used. Preferred yellow couplers include α-pivaloyl-acetanilide type couplers. Preferred magenta couplers include 5-pyrazolone type, more preferably 1-phenyl-5-pyrazolone type, and still more preferably 1-phenyl-3-anilino-5-pyrazolone type couplers and pyrazolotriazole type couplers. Preferred cyan couplers include phenol type couplers.

These couplers each may be contained in an amount of 0.05 to 1 mole per mole of silver halide in each of the silver halide emulsion layers.

In light-sensitive materials of the invention, of these silver halide emulsion layers, the one located furthest from the support is provided on the reverse side thereof to the support with a non-light-sensitive layer.

This non-light-sensitive layer comprises a hydrophilic binder such as gelatin, a gelatin derivative or polyvinyl alcohol.

And, into this non-light-sensitive layer are incorporated both a given ultraviolet absorbing agent and a given high boiling solvent together.

In this case, the binder coating amount for the non-light-sensitive layer is usually from 1 to 30 mg/dm$^2$.

The ultraviolet absorbing agent to be used in the invention is one of those benzotriazole type compounds having Formula [I].

Those other than the above compounds are unable to produce any specified effect of the present invention.

In the Formula [I], an alkyl radical having not less than 4 carbon atoms being represented respectively by $R_1$ and $R_2$ is preferably one of those having from 4 to 8 carbon atoms and more preferably one of those having from 4 to 6 carbon atoms and out of which butyl, pentyl or hexyl radical and the like are given as the examples; and an an aryl radical represented respectively by $R_1$ and $R_2$, phenyl radical is given as the example; as an alkoxy radical, those having from 4 to 8 carbon atoms are preferable and out of which butoxy or octyloxy radical and the like are given as the examples; as an aryloxy radical, phenoxy radical is given as the example; and as an alkenyl radical, those having from 4 to 8 carbon atoms among which butenyl, pentenyl or hexenyl radical and the like are given as the examples. Next, as a halogen atom represented by $R_3$, chlorine or bromine atom and the like are preferable; and as an alkyl, aryl, alkoxy, aryloxy or alkenyl radical, there are the radicals synonimous with the respective radicals represented by $R_1$ and $R_2$. And, as the particularly preferred radicals represented by $R_3$, hydrogen atom and chlorine atom are given as the examples.

The following are typical examples of those benzotriazole type ultraviolet-ray absorbing agents having Formula [I]:

UV-1

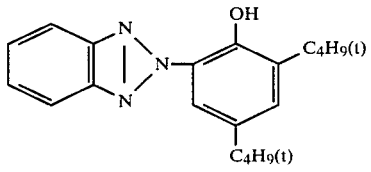

-continued

UV-2

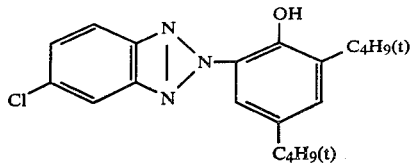

UV-3

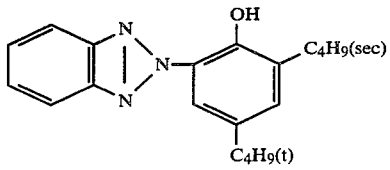

UV-4

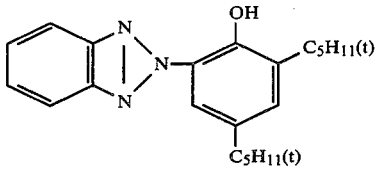

UV-5

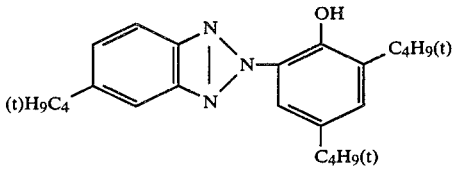

UV-6

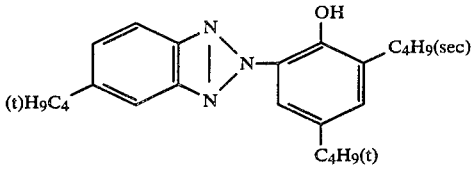

UV-7

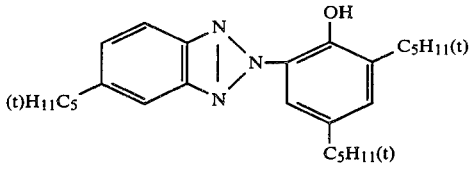

UV-8

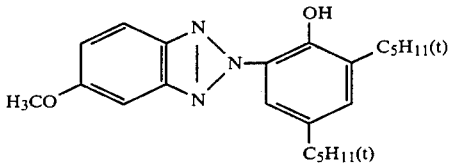

UV-9

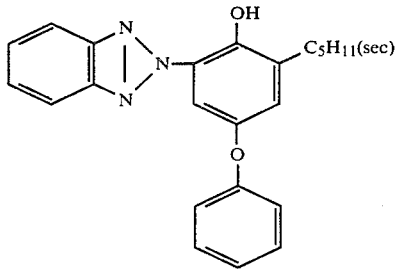

-continued

UV-10

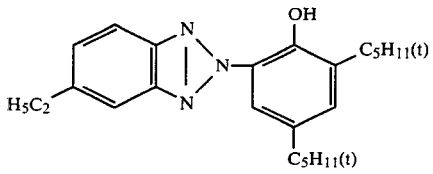

UV-11

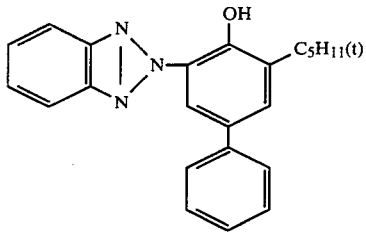

UV-12

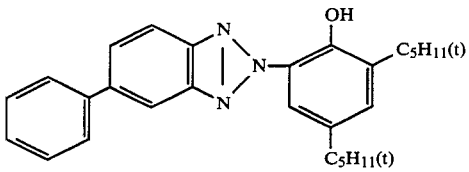

UV-13

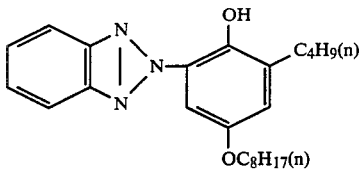

These ultraviolet-rat absorbing agents having Formula [I] are as described in Japanese Patent Examined Publication Nos. 10466/1961, 26187/1967, 5496/1973 and 41572/1973, and U.S. Pat. Nos. 3,754,914 and 4,220,711.

The amount of an ultraviolet-ray absorbing agent relating to the invention to be incorporated into the non-light-sensitive layer is from 0.001 to 2 per part by weight of the binder of the layer.

On the other hand, the high boiling solvent to be used in the invention is a compound having either Formula [II] or Formula [III].

Any compounds other than those mentioned above are unable to produce the effect of the present invention.

In Formula [II], an alkyl radical having not less than 5 carbon atoms represented respectively by $R_4$ and $R_5$ includes those having from 5 to 16 carbon atoms and more preferably those having from 8 to 12 carbon atoms among which octyl, nonyl or dodecyl radical and the like may be given as the examples; and as an aryl radical, phenyl radical is given.

Next, in Formula [III], an alkyl radical having not less than 5 carbon atoms represented respectively by $R_6$, $R_7$ and $R_8$ includes preferably those having from 5 to 16 carbon atoms and more preferably those having from 8 to 12 carbon atoms, and among which octyl, nonyl or dodecyl radical and the like may be given as the examples.

Typical examples of those high boiling solvents having Formula [II] or Formula [III] are as follows:

II-1

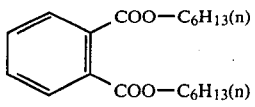

II-2

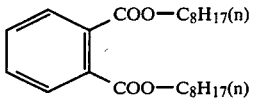

II-3

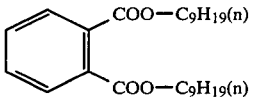

II-4

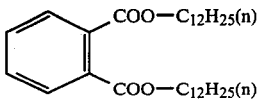

II-5

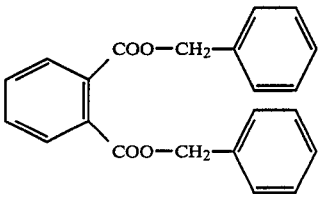

II-6

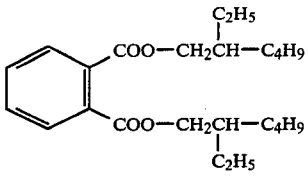

III-1

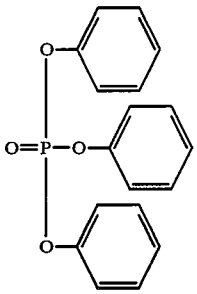

III-2

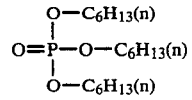

-continued

III-3

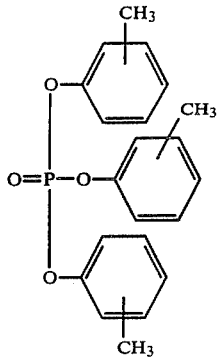

III-4

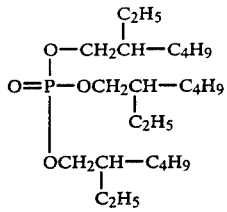

III-5

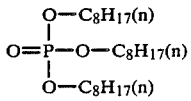

III-6

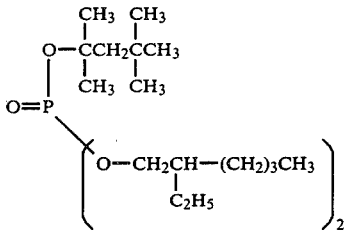

III-7

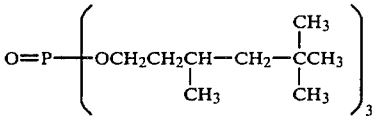

III-8

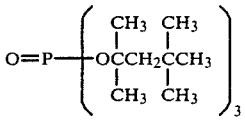

III-9

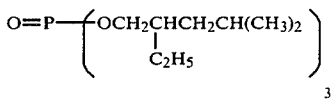

III-10

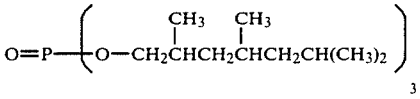

III-11

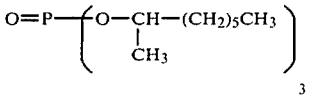

-continued

III-12

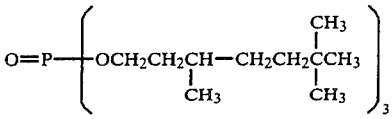

III-13

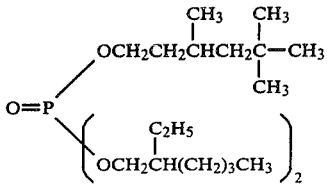

III-14

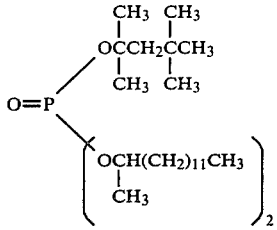

These high boiling solvents represented by Formulas [II] and [III] are described in U.S. Pat. No. 2,304,939, and Japanese Patent Publication Open to Public Inspection (hereinafter referred to as Japanese Patent O.P.I. Publication) Nos. 119235/1979, 48535/1979, 119921/1979, 119922/1979, and the like.

In addition, these high boiling solvents relating to the invention may be used in combination of two or more kinds, and may also be used in combination with other high boiling solvents if the effects of the invention are not damaged.

Such high boiling solvents relating to the invention are used in an amount of not more than 5 parts by weight, normally from 0.01 to 5 parts by weight per part by weight of the ultraviolet-ray absorbing agent.

In order to incorporate the ultraviolet-ray absorbing agent and the high boiling solvent both relating to the invention into the non-light-sensitive layer of the invention, as has been heretofore known, the ultraviolet-ray absorbing agent is dissolved into the high boiling solvent, if necessary, into a mixture of the solvent with a low boiling solvent, and the solution is finely dispersed with the aid of a surface active agent into a hydrophilic binder such as an aqueous solution of gelatin, and the resulting dispersed product is then added to the aforegoing non-light-sensitive hydrophilic colloidal layer.

Namely, the ultraviolet-ray absorbing agent is dissolved into the high boiling solvent, if necessary, together with a low boiling solvent such as methyl acetate, ethyl acetate, propyl acetate, butyl acetate, butyl propionate; cyclohexanol, cyclohexane, tetrahydrofuran, methyl alcohol, ethyl alcohol, acetonitrile, dimethyl formamide, dioxane, methyl-ethyl ketone, methyl-isobutyl ketone, diethyleneglycol monoacetate, acetyl acetone, nitromethane, nitroethane, carbon tetrachloride, chloroform, or the like (these solvents are allowed to be used either singly or in a mixture).

The resulting solution is then mixed with an aqueous solution containing such a hydrophilic binder as gelatin containing an anionic surface active agent such as alkylbenzenesulfonic acid, alkylnaphthalenesulfonic acid, or the like, and/or a nonionic surface active agent such as solbitansesquioleic acid ester, solbitanmonolauric acid ester, or the like.

This mixture is emulsified to be dispersed by means of a high-speed rotary mixer, colloid mill or ultrasonic disperser, and then added to a hydrophilic colloid to be used as a non-light-sensitive layer.

In addition, it is desired that on the reverse side to the support of this non-light-sensitive layer be formed contiguously thereto another non-light-sensitive layer as a protective layer consisting substantially of a hydrophilic binder alone.

By doing this, the phenomenon that the surface gloss loses with time, the so-called "sweat", becomes remarkably reduced.

In addition, the coating amount of this non-light-sensitive layer is generally from 1 to 30 mg/dm$^2$.

Further, it is desirable that a first interlayer be provided in between the emulsion layer located closest to the support and the emulsion layer in the middle, and a second interlayer in between the emulsion layer in the middle and the emulsion layer located furthest from the support.

And it is desirable that the second interlayer which is farther from the support contain the foregoing ultraviolet-ray absorbing agent. The adding amount of the ultraviolet-ray absorbing agent is generally from 0.01 to 50 parts by weight per part by weight of the same agent to be added to the foregoing non-light-sensitive layer.

By doing this, the resistance to light and the antifog effect of the dye image can be further improved.

In addition, these first and second interlayers also have a hydrophilic binder, the coating amount of which is desirable to be from 1 to 30 mg/dm$^2$ for both layers, respectively.

In the case of adding an ultraviolet-ray absorbing agent to the second interlayer or, if necessary, also to the first interlayer, no restriction is imposed on the ultraviolet-ray absorbing agent to be used; the agent can be any one not only of those compounds relating to the invention but of other known ultraviolet-ray absorbing agents. In this case, if satisfactory in the compatibility with a high boiling solvent and less dispersible in the layer; this condition is well satisfied by benzotriazole type compounds which are included in the compounds relating to the invention. The use of the above ultraviolet-ray absorbing agent relating to the invention leads to better results.

High boiling solvents usable together with the above ultraviolet-ray absorbing agent include organic acid amides, carbamates, esters, ketones, urea derivatives, and the like.

Those most useful among them are esters including, particularly, phthalic acid esters such as dimethyl phthalate, diethyl phthalate, dipropyl phthalate, dibutyl phthalate, di-n-octyl phthalate, diisooctyl phthalate, diamyl phthalate, dinonyl phthalate, diisodecyl phthalate, and the like; phosphoric acid esters such as tricresyl phosphate, triphenyl phosphate, tri-(2-ethyl-hexyl)-phosphate, triisononyl phosphate, and the like; sebacic acid esters such as dioctyl sebacate, di-(2-ethyl-hexyl)-sebacate, dimethodecyl sebacate, and the like; glycerol esters such as glycerol tripropionate, glycerol tributyrate, and the like; and further, adipic acid esters, glutaric acid esters, succinic acid esters, maleic acid esters, fumaric acid esters, citric acid esters, and the like. These compounds may be applied singly or in combination. Particularly preferred among these compounds are those relating to the invention.

The following example illustrates a preferred embodiment of the layer arrangements of a color photographic light-sensitive material of the invention:

| | |
|---|---|
| Layer 7 | Protective layer |
| Layer 6 | Ultraviolet-ray absorbing layer<br>Into a hydrophilic colloidal gelatin, an ultraviolet-ray absorbing agent having Formula [I] and a high boiling solvent having either Formula [II] or Formula [III] were emulsified to disperse, and the dispersed matter was coated to produce Layer 2. |
| Layer 5 | Red-sensitive emulsion layer |
| Layer 4 | Second interlayer<br>The coating composition is same as that of the abovementioned ultraviolet-ray absorbing layer. |
| Layer 3 | Green-sensitive emulsion layer |
| Layer 2 | First interlayer |
| Layer 1 | Blue-sensitive emulsion layer |
| Support | Polyethylene coated paper |

In addition, the non-light-sensitive layer on the emulsion layer which is farthest from the support, and the first and second non-light-sensitive interlayers may, if necessary, contain an anti-color-mixing agent such as dioctyl hydroquinone, dibutyl hydroquinone, or the like, a whiteness adjusting agent, a coating aid, and the like.

The dispersion of couplers in the emulsion layer of the present invention can be made by an appropriate dispersing method arbitrarily selected according to the chemical structures of couplers to be used from among various dispersing methods such as the so-called alkali aqueous solution dispersing method, solid dispersing method, latex dispersing method, oil-in-water-type emulsification dispersing method, and the like. In the present invention, the latex dispersing method and the oil-in-water type emulsification dispersing method are particularly useful.

These dispersing methods have been conventionally well known. The latex dispersing method and the effect thereof are as described, for example, in Japanese Patent O.P.I. Publication Nos. 74538/1974, 59943/1976 and 32552/1979, and Research Disclosure No. 14850, Aug. 1976, pp 77–79.

Appropriate latexes applicable to the method are homopolymers, copolymers and terpolymers of such monomers as, e.g., styrene, ethyl acrylate, n-butyl acrylate, n-butyl methacrylate, 2-acetoacetoxyethyl methacrylate, 2-(methacryloyloxy)ethyl-trimethylammonium methosulfate, sodium 3-(methacryloyloxy)propane-1-sulfonate, N-isopropylacrylamide, N-[2-(2-methyl-4-oxopentyl)]acrylamide, 2-acrylamido-2-methyl-propane-sulfonic acid, and the like.

As the oil-in-water-type emulsification dispersing method, there may be applied conventionally known methods for dispersing hydrophobic additives such as couplers, which are such that the foregoing nondiffusion coupler is dissolved into a high-boiling solvent such as, e.g., N-n-butylacetanilide, diethyllauramide, dibutyl phthalate, tricresyl phosphate, N-dodecylpyrolidone, etc., and the solution is finely dispersed into a hydrophilic colloid such as gelatin.

Silver halides usable for the respective silver halide emulsion layers of the light-sensitive material in the present invention include those arbitrarily usable in general silver halide photographic emulsions, such as silver chloride, silver bromide, silver iodide, silver chlorobromide, silver iodobromide, silver chloroiodobromide, and the like.

The particles of these silver halides are allowed to be either of the coarse-grained type or the fine-grained type, and the particle distribution is allowed to be either wider or narrower.

The crystal of these silver halide particles to be used may be either normal or twin, and may be of an arbitrary proportion of the [100] face to the [111] face thereof. Further, the crystal structure of these silver halide particles may be either uniform from the internal to the external or stratified with the internal and the external different in nature from each other. And these silver halides may be either of the type that latent image is mainly formed on the surface of the particle or of the type that latent image is formed inside the particle.

These silver halide particles may be prepared by those known methods practiced by those skilled in the art.

The respective silver halide emulsions for use in the light-sensitive material of the present invention, although desirable to be free of the soluble salts thereof, may be used without desalting. And the silver halide emulsions each may be a mixture of not less than two different silver halide emulsions.

As the binders for use in the silver halide emulsion layers or in the non-light-sensitive layers, those conventionally known may be used. Those most suitably usable include, e.g., gelatin and gelatin derivatives such as phenylcarbamylated gelatin, acylated gelatin, phthalated gelatin, and the like. These binder materials may, if necessary, be used in a compatible mixture of not less than two of them.

A silver halide photographic emulsion prepared by dispersing the silver halide particles into a binder liquid may be sensitized by chemical sensitizers. Those chemical sensitizers advantageously applicable to the present invention are broadly classified into four: noble-metal sensitizers, sulfur sensitizers, selenium sensitizers and reduction sensitizers.

The noble-metal sensitizers include gold compounds and compounds of ruthenium, rhoduim, palladium, iridium, platinum, or the like.

In addition, when using a gold compound, ammonium thiocyanate or sodium thiocyanate may be used together.

As the sulfur sensitizers, sulfur compounds as well as active gelatin may be used.

As the selenium sensitizers, both active and inert selenium compounds may be used.

The reduction sensitizers include stannous salts, polyamines, bis-alkylaminosulfide, silane compounds, iminoaminometasulfinic acid, hydrazinium salts and hydrazine derivatives.

To the light-sensitive material of the present invention, in addition to the above-described additives, may be further added a stabilizer, development accelerator, hardener, surface active agent, antistain agent, lubricant, fluorescent whitening agent, mordant, DIR compound, or various other additives useful for photographic light-sensitive materials.

Furhter, the light-sensitive material of the present invention may be arbitrarily provided with a backing layer and the like in addition to the silver halide emulsion layers and the foregoing non-light-sensitive layers.

For the reflective support of the light-sensitive material of the present invention, any material can be used which is arbitrarily selected according to uses from among those conventionally known materials such as plastic-laminated paper, baryta paper, synthetic paper and the like. These materials, when used as a support, are generally subjected to various subbing processings for increasing the adherence thereof with a photographic emulsion layer.

The light-sensitive material of the present invention, after being exposed to light through a negative light-sensitive material having an image composed of coupling products, is subjected to color development.

The color development is made in a usual color development process. Namely, the exposed light-sensitive material is first processed in a color developer liquid containing a color developing agent, or, the light-sensitive material is incorporated in advance with a color developing agent or the precursor thereof, the material is then processed in what is called an activator liquid.

After that, the material, according to the normally practiced manner, is then processed in bleaching and fixing baths.

In this case, the color development process by a color developer liquid or by an activator liquid, the bleaching process and the fixing process may be conducted independently, but not less than two of these processes, instead of being conducted independently, may also be conducted at a time (in a single bath) by use of a processing liquid having the functions thereof; i.e., by use of a monobath processing method, for an example, which uses a color developer or an activator containing both of a bleaching agent and a fixing agent as will be described hereinafter, or a processing method, for another example, which, after color development, uses a bleach-fixer monobath containing both bleaching and fixing agents for bleaching and fixing the developed image.

Although the processing by a developer liquid or by a activator liquid may be immediately followed by the desilvering by a bleach-fixer bath or the like, an acid stop process may be provided in between the color development process and the processes for bleaching and for fixing. As such an acid stop bath, an aqueous solution of acetic acid, citric acid or the like may be used. And further, if necessary, there may be provided a prehardening process, a process for neutralizing, a washing process, a stabilizing process and the like.

As a result of such color development processes, a dye image is formed on the print-making light-sensitive material by the coupling reactions.

In addition, typical color developing agents applicable to the development of the light-sensitive material of the present invention are aromatic primary amine color developing agents.

Aromatic primary amine color developing agents include aminophenol-type and p-phenylenediamine-type derivatives, and these compounds may be used in the free state or in the form of the hydrochloride or sulfate thereof or of such organic acid salts as the p-toluene-sulfonate, tetraphenyl-borate, p-(t-octyl)benzene-sulfonate thereof, and the like.

Typical examples of aromatic primary amine color developing agents are O-aminophenol, P-aminophenol, 5-amino-2-oxytoluene, 2-amino-3-oxytoluene, 2-oxy-3-amino-1,4-dimethylbenzene, N,N-diethyl-P-phenylenediamine hydrochloride, N-methyl-P-phenylenediamine hydrochloride, N,N-dimethyl-P-phenylenediamine hydrochloride, N-ethyl-N-$\beta$-methanesulfonaminoethyl-3-methyl-4-aminoaniline and the sulfate thereof, N-ethyl-N-$\beta$-hydroxyethylaminoaniline, N,N-diethyl-3-($\beta$-methanesulfonamidoethyl)-4-aminoaniline hydrochloride, 4-amino- N-(2-methoxyethyl)-N-ethyl-3-methylaniline-P-toluene sulfonate, N-ethyl-N-β-methanesulfonamidoethyl-3-methyl-4-aminoaniline-tetraphenyl borate, 4-amino-N-(2-methoxyethyl)-N-ethyl-3-methylanilinetetraphenyl borate, P-morpholinoaniline, P-piperidinoaniline, 4-amino-N,N-diethyl-3-chloroaniline, and the like.

In addition, if necessary, the light-sensitive material of the present invention may contain a color developing agent precursor. The color developing agent precursor is a compound that is capable of producing a color developing agent under an alkaline condition, the color developing agent precursor being one of those compounds including, e.g., precursors of the Schiff's base type with aromatic aldehyde derivatives, multivalent metallic ion complex precursors, phthalic acid imide derivative precursors, phosphoric acid amide precursors, sugaramine reaction product precursors and urethane-type precursors.

These aromatic primary amine color developing agent precursors are described in, e.g., U.S. Pat. Nos. 3,342,599, 2,507,114, 2,695,234 and 3,719,492, British Pat. No. 803,783, Japanese Patent O.P.I. Publication Nos. 135628/1978 and 79035/1979, and Research Disclosure Nos. 15159, 12146 and 13924.

Any of these aromatic primary amine color developing agents is usually incorporated in an amount of from 1 to 20 g/liter into a color developer liquid. In the case of incorporating it in the form of a precursor into the light-sensitive material, the precursor is used in an amount of from 0.5 to 3 moles per mole of the silver halide.

A color developer liquid or activator liquid to be used for the light-sensitive material of the present invention contains an alkaline agent such as potassium hydroxide, sodium hydroxide, sodium carbonate, potassium carbonate, sodium tertiary phosphate, potassium tertiary phosphate, or the like; a sulfite such as sodium sulfite, potassium sulfite, or the like; a bromide such as sodium bromide, potassium bromide, ammonium bromide, or the like; and may, if necessary, further contain a known development restrainer; a thiocyanate such as sodium thiocyanate, potassium thiocyanate, ammonium thiocyanate, or the like; a chloride such as ammonium chloride, potassium chloride, sodium chloride, or the like; an organic solvent such as ethylene glycol, diethylene glycol, methanol, ethanol, n-butanol, benzyl alcohol, acetone, dimethyl formamide, or the like; an amine such as hydroxylamine, ethanolamine, ethylenediamine, diethanolamine, or the like; a water softener such as sodium hexametaphosphate, sodium tripolyphosphate, ethylenediaminetetraacetic acid, diethylenetriaminepentaacetic acid, or the like; a water-soluble fluorescent whitening agent; and the like.

The color developer liquid or activator liquid for use in the present invention may contain an auxiliary agent of developer. As the auxiliary agents of developer, a 1-aryl-3-pyrazolidone derivative is preferred which is used in an amount of from 1 mg to 1 g, and preferably from 10 mg to 500 mg per liter of the color developer or activator. Typical examples of such auxiliary agents of developer are 1-phenyl-3-pyrazolidone, 4-methyl-1-phenyl-3-pyrazolidone, 4,4-dimethyl-1-phenyl-3-pyrazolidone, 4-methyl-4-hydroxymethyl-1-phenyl-3-pyrazolidone, 4-methyl-4-hydroxymethyl-1-(P-tolyl)-3-pyrazolidone, and the like.

The color developer liquid or activator for use in the present invention is kept alkaline in the usual way, and the hydroxide ion concentration thereof may be arbitrarily selected according to the kind, composition, purpose and use of a negative light-sensitive material to be used or of the print-making light-sensitive material to be used in the present invention, but it is generally from pH 9.5 to 13.5.

The color developer liquid or activator liquid for use in the present invention is used generally in a certain temperature range. The temperature range, although arbitrarily selectable according to the kind, composition, use and purpose of the print-making light-sensitive material of the present invention, is preferably from 15° C. to 70° C., and more preferably from 30° C. to 50° C.

As the bleaching agents for use in the bleaching or bleach-fixing bath, any of those known compounds may be used which include such ferric complex salts of aminopolycarboxylic acid as, e.g., ferric-sodium ethylenediaminetetraacetate, ferric-ammonium ethylenediaminetetraacetate, and the like, and persulfates such as ammonium persulfate, sodium persulfate, and the like.

As the fixing agents for use in the fixing or bleach-fixing bath, any of those known compounds may be used which include, e.g., thiosulfates such as sodium thiosulfate, ammonium thiosulfate, and the like, water-soluble sulfur-containing diols such as 3,6-dithia-1,8-octanediol, 3,6,9,12-tetrathia-1,14-tetradecanediol, and the like, and water-soluble sulfur-containing dibasic acids such as ethylene-bis-thioglycolic acid, sodium ethylene-bis-thioglycolate, and the like.

With the light-sensitive materials of the present invention being comprised as detailedly described above, the possible decoloration of the dye image being caused by light is remarkably improved during the storage under a high temperature and high humidity conditions.

Further, therewith, the possible electrostatic marks caused in coating or drying the component layers thereof and also in transit thereof in a printer.

The following examples will further illustrate the present invention.

EXAMPLE 1

A silver halide color photographic light-sensitive material having the component layers as given in the following Table 1—1 was prepared.

TABLE 1-1

| | | Coating amount of Ag ($mg/dm^2$) | Coating amount of gelatin ($mg/dm^2$) | Coating amount of UV-absorbing agent ($mg/dm^2$) | Kind of coupler |
|---|---|---|---|---|---|
| 6th layer | UV-absorbing layer | — | 15 | 4.0 | — |
| 5th layer | Red-sensitive EM layer | 3.0 | 20 | — | C-1 |
| 4th layer | 2nd interlayer | — | 15 | 4.0 | — |
| 3rd layer | Green-sensitive EM layer | 3.0 | 20 | — | M-1 |
| 2nd layer | 1st interlayer | — | 15 | — | — |
| 1st layer | Blue-sensitive EM layer | 4.0 | 20 | — | Y-1 |

The above layers were coated on a polyethylene-coated paper support.

In the Table above, the structures of Yellow Coupler Y-1, Magenta Coupler M-1 and Cyan Coupler C-1 used herein are as follows:

Y-1

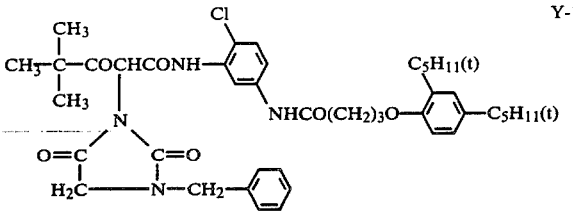

M-1

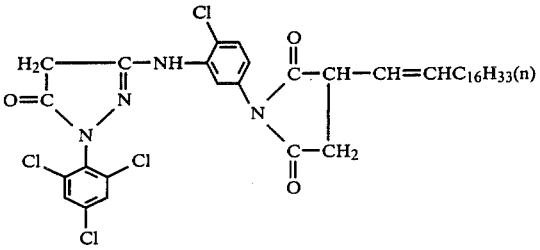

C-1

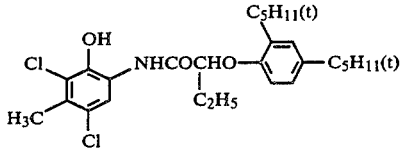

In coating the 2nd layer, comparative Ultraviolet-ray Absorbing Agents, UV-A, UV-B, UV-C and UV-D, which have the following formulas, and Ultraviolet-ray Absorbing Agents, UV-1, UV-2, UV-3 and UV-4, which are exemplified for the present invention were used.

UV-A

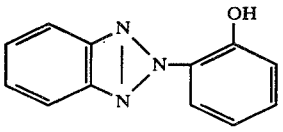

UV-B

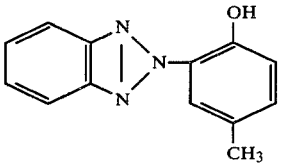

UV-C

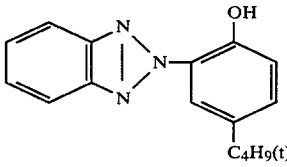

UV-D

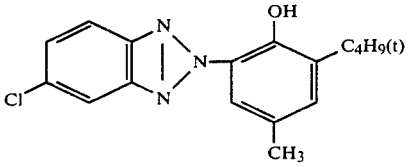

As for high-boiling solvents, diethyl phthalate (DEP) and dibutyl phthalate as comparative solvents, dioctyl phthalate (DOP) having Formula [II], and tributyl phosphate (TBP) for comparison, and trioctyl phosphate (TOP) and tricresyl phosphate (TCP) which have Formula [III] were used.

And, each of the foregoing ultraviolet-ray absorbing agents and each of these high-boiling solvents were mixed to be dissolved respectively in the proportion by weight of 1:1 by use of a 4-fold quantity of ethyl acetate, and the solution was emulsified to be dispersed, with the aid of a surface active agent, Alkanol XC (produced by DuPont), into an aqueous gelatin solution by means of a high-speed rotary mixer and, after that, was coated and then dried to prepare the respective Samples No. 1 to No. 48 as shown in Table 1-2-1, Table 1-2-2 and Table 1-2-3.

In addition, in the 4th layer of each sample, the same ultraviolet-ray absorbing agent and high-boiling solvent as those in the 2nd layer are used.

Each of these samples No. 1 to No. 48 was exposed through an optical wedge to blue, green and red lights by use of a sensitometer (Model KS-7, manufactured by Konishiroku Photo Ind., Co., Ltd.) and then was processed according to the following development process steps.

| Development processes: | Temperature (°C.) | Time |
|---|---|---|
| Color development | 33 | 3' 30" |
| Bleach-fixing | 33 | 1' 30" |
| Washing | 33 | 3' |
| Drying | 80 | |

The processing solutions to be used for the above steps are listed below:

| | |
|---|---|
| Color Developer: | |
| Pure water | 700 ml |
| Benzyl alcohol | 15 ml |
| Diethylene glycol | 15 ml |
| Hydroxylamine sulfate | 2 g |
| N—ethyl-N—β-methanesulfonamido-ethyl-3-methyl-4-aminoaniline sulfate | 4.4 g |
| Potassium carbonate | 30 g |
| Potassium bromide | 0.4 g |
| Potassium chloride | 0.5 g |
| Potassium sulfite | 2 g |
| Pure water to make 1 liter, pH 10.2 | |
| Bleach-Fixer: | |
| Iron-ammonium ethylenediamine-tetraacetate | 61 g |
| Diammonium ethylenediamine-tetraacetate | 5 g |
| Ammonium thiosulfate | 125 g |
| Sodium metabisulfite | 13 g |
| Sodium sulfite | 2.7 g |
| Pure water to make 1 liter, pH 7.2 | |

Each of thus obtained samples was exposed separately to a xenon fade meter over 200 hours under a condition of a temperature of 40° C. without humidification and under another condition of a temperature of 40° C. and humidity of 80% RH.

Difference between the unexposed density (Do=1.0) and the after-exposure density (D), and the proportion of the difference to the unexposed density (Do-D)/Do were measured by use of a SAKURA Densitometer Model PD-6 (manufactured by Konishiroku Photo Ind. Co., Ltd.).

The dye-discoloration degrees (Do-D)/Do thus obtained of the yellow dye (Y), magenta dye (M) and cyan dye (C) are given in the following Table 1-2-1, Table 1-2-2 and Table 1-2-3.

TABLE 1-2-1

| Sample No. | UV-absorbing agent | High-boiling solvent | Discoloration degree (40° C., no humidification) Y | M | C | Discoloration degree (40° C. 80% RH) Y | M | C |
|---|---|---|---|---|---|---|---|---|
| 1 | UV-A (control) | DEP (control) | 19 | 22 | 17 | 36 | 37 | 39 |
| 2 | | DBP (control) | 20 | 21 | 16 | 31 | 33 | 37 |
| 3 | | DOP | 19 | 21 | 16 | 32 | 36 | 38 |
| 4 | | TBP (control) | 20 | 22 | 17 | 36 | 37 | 39 |
| 5 | | TOP | 20 | 20 | 17 | 32 | 36 | 37 |
| 6 | | TCP | 20 | 20 | 16 | 32 | 33 | 36 |
| 7 | UV-B (control) | DEP (control) | 20 | 21 | 18 | 35 | 40 | 39 |
| 8 | | DBP (control) | 19 | 20 | 16 | 32 | 35 | 37 |
| 9 | | DOP | 18 | 20 | 16 | 33 | 36 | 37 |
| 10 | | TBP (control) | 20 | 22 | 17 | 37 | 38 | 39 |
| 11 | | TOP | 19 | 21 | 16 | 32 | 35 | 36 |
| 12 | | TCP | 19 | 21 | 16 | 31 | 34 | 36 |
| 13 | UV-C (control) | (control) DEP (control) | 19 | 20 | 17 | 37 | 37 | 38 |
| 14 | | DBP | 20 | 20 | 17 | 31 | 33 | 36 |
| 15 | | DOP | 19 | 19 | 16 | 32 | 34 | 37 |
| 16 | | TBP (control) | 20 | 21 | 18 | 38 | 39 | 39 |
| 17 | | TOP | 19 | 20 | 16 | 33 | 35 | 36 |
| 18 | | TCP | 18 | 20 | 17 | 32 | 34 | 38 |

TABLE 1-2-2

| Sample No. | UV-absorbing agent | High-boiling solvent | Discoloration degree (40° C., no humidification) Y | M | C | Discoloration degree (40° C., 80% RH Y | M | C |
|---|---|---|---|---|---|---|---|---|
| 19 | UV-D (control) | DEP (control) | 20 | 20 | 17 | 36 | 37 | 39 |
| 20 | | DBP (control) | 19 | 21 | 16 | 31 | 34 | 37 |
| 21 | | DOP | 19 | 22 | 16 | 32 | 35 | 38 |
| 22 | | TBP (control) | 20 | 22 | 17 | 37 | 37 | 40 |
| 23 | | TOP | 19 | 21 | 16 | 32 | 35 | 36 |
| 24 | | TCP | 18 | 22 | 15 | 33 | 33 | 37 |
| 25 | UV-1 | DEP (control) | 18 | 21 | 15 | 28 | 30 | 30 |
| 26 | | DBP (control) | 16 | 21 | 16 | 27 | 29 | 30 |
| 27 (invention) | | DOP | 16 | 18 | 15 | 16 | 18 | 16 |
| 28 | | TBP (control) | 17 | 19 | 16 | 28 | 29 | 29 |
| 29 (invention) | | TOP | 18 | 19 | 15 | 18 | 19 | 15 |
| 30 (invention) | | TCP | 17 | 18 | 14 | 18 | 19 | 15 |
| 31 | UV-2 | DEP (control) | 17 | 20 | 15 | 27 | 31 | 31 |
| 32 | | DBP (control) | 17 | 20 | 16 | 28 | 30 | 31 |
| 33 (invention) | | DOP | 16 | 19 | 14 | 16 | 19 | 15 |
| 34 | | TBP (control) | 17 | 20 | 15 | 27 | 31 | 30 |
| 35 (invention) | | TOP | 17 | 19 | 16 | 17 | 19 | 16 |
| 36 (invention) | | TCP | 16 | 19 | 14 | 17 | 19 | 15 |

TABLE 1-2-3

| Sample No. | UV-absorbing agent | High-boiling solvent | Discoloration degree (40° C., no humidification) Y | M | C | Discoloration degree (40° C., 80% RH Y | M | C |
|---|---|---|---|---|---|---|---|---|
| 37 | UV-3 | DEP (control) | 18 | 19 | 15 | 27 | 29 | 30 |
| 38 | | DBP (control) | 18 | 20 | 17 | 28 | 29 | 29 |
| 39 (invention) | | DOP | 19 | 19 | 15 | 19 | 19 | 16 |
| 40 | | TBP (control) | 18 | 19 | 17 | 26 | 28 | 30 |
| 41 (invention) | | TOP | 17 | 19 | 16 | 17 | 19 | 17 |
| 42 (invention) | | TCP | 17 | 18 | 16 | 17 | 18 | 16 |
| 43 | UV-4 | DEP (control) | 17 | 20 | 15 | 27 | 28 | 29 |
| 44 | | DBP (control) | 17 | 20 | 15 | 28 | 29 | 30 |
| 45 (invention) | | DOP | 16 | 18 | 16 | 16 | 18 | 17 |
| 46 | | TBP (control) | 18 | 20 | 17 | 27 | 29 | 29 |
| 47 (invention) | | TOP | 17 | 19 | 15 | 17 | 19 | 16 |
| 48 (invention) | | TCP | 16 | 18 | 16 | 17 | 18 | 16 |

From the results shown in Table 1-2-1 to Table 1-2-3, it is understood that the samples using both the ultraviolet-ray absorbing agent for the invention and the high-boiling solvent for the invention together, when exposed under a low-humidity condition, are almost equal in the light-resistance to and, when exposed under a high-humidity condition, are much superior in the light-resistance to those wherein either the ultraviolet-ray absorbing agent for the invention or the high-boiling solvent for the invention is independently used, i.e., used with comparative one.

EXAMPLE 2

Cyan Coupler C-2, Magenta Coupler M-2 and Yellow Coupler Y-2 which have the following formulas were used in place of the couplers used in Example 1 to prepare, in the same manner as in Example 1, Samples No. 49 to No. 64 as shown in Table 2-1.

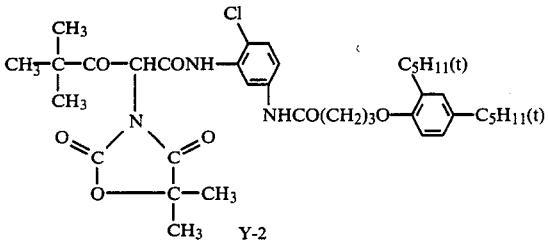

Y-2

M-2

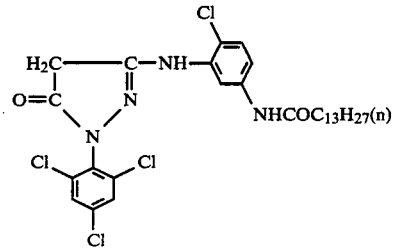

-continued

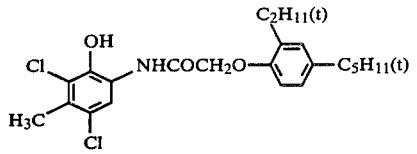

C-2

In addition, the proportion by weight of the ultraviolet-ray absorbing agent to the high-boiling solvent was changed to 1:0.75.

These Samples No. 49 to No. 64 were developed in the same process as in Example 1.

The thus obtained samples, dividing each into two, were separately put in two desiccators: one whose inside was conditioned at a relative humidity of 10% at 40° C. (controlled by a saturated $ZnCl_2$ solution) and the other whose inside was conditioned at a relative humidity of 81% at 40° C. (controlled by a saturated $(NH_4)_2SO_4$ solution) and then exposed to the sunlight over a period of 20 days, and after that the dye discoloration degrees at the areas of unexposed density Do=1.0 of the samples were measured. The results are as shown in Table 2-1.

TABLE 2-1

| Sample No. | UV-absorbing agent | High-boiling solvent | Discoloration degree (40° C., 10% RH) Y | M | C | Discoloration degree (40° C., 81% RH) Y | M | C |
|---|---|---|---|---|---|---|---|---|
| 49 | UV-B (control) | DBP (control) | 18 | 20 | 17 | 30 | 31 | 33 |
| 50 | | DOP | 19 | 19 | 16 | 28 | 32 | 32 |
| 51 | | TBP (control) | 18 | 19 | 17 | 30 | 32 | 33 |
| 52 | | TCP | 18 | 20 | 16 | 29 | 30 | 31 |
| 53 | UV-D (control) | DBP (control) | 17 | 19 | 16 | 29 | 32 | 32 |
| 54 | | DOP | 17 | 20 | 17 | 27 | 31 | 31 |
| 55 | | TBP (control) | 19 | 19 | 16 | 30 | 32 | 33 |
| 56 | | TCP | 18 | 19 | 16 | 27 | 31 | 32 |
| 57 | UV-1 | DBP (control) | 17 | 20 | 16 | 24 | 26 | 28 |
| 58 (invention) | | DOP | 17 | 19 | 15 | 17 | 19 | 16 |
| 59 | | TBP (control) | 18 | 19 | 17 | 25 | 27 | 30 |
| 60 (invention) | | TCP | 17 | 18 | 15 | 17 | 18 | 16 |
| 61 | UV-4 | DBP (control) | 17 | 19 | 15 | 25 | 28 | 27 |
| 62 (invention) | | DOP | 17 | 18 | 15 | 17 | 18 | 15 |
| 63 | | TBP (control) | 17 | 18 | 16 | 26 | 29 | 28 |
| 64 (invention) | | TCP | 15 | 17 | 15 | 16 | 17 | 16 |

As is apparent from the results shown in Table 2-1, it is understood that the combined use of the ultraviolet-ray absorbing agent for the present invention with the high-boiling solvent for the invention, also in the exposure to the sunlight, shows much excellent dye-discoloration-preventive effect under a high-humidity condition as compared to the independent use of either the agent or the solvent.

EXAMPLE 3

A silver halide color photographic light-sensitive material having such component layers as shown in Table 3-1 was prepared.

TABLE 3-1

| | | Coating amount of Ag (mg/dm²) | Coating amount of gelatin (mg/dm²) | Coating amount of UV-absorbing agent (mg/dm²) | Kind of coupler |
|---|---|---|---|---|---|
| 7th layer | Protective layer | — | 15 | — | — |
| 6th layer | UV-absorbing layer | — | 15 | 4.0 | — |
| 5th layer | Red-sensitive EM layer | 3.0 | 20 | — | C-2 |
| 4th layer | 2nd interlayer | — | 15 | 4.0 | — |
| 3rd layer | Green-sensitive EM layer | 3.0 | 20 | — | M-2 |
| 2nd layer | 1st interlayer | — | 15 | — | — |
| 1st layer | Blue-sensitive EM layer | 4.0 | 20 | — | Y-2 |

The above layers were coated on a polyethylene-coated paper support

The ultraviolet-ray absorbing agents and high-boiling solvents indicated in Table 3-2 were used to prepare Samples No. 65 to No. 80. In this case, the proportion by weight of the ultraviolet-ray absorbing agent to the high-boiling solvent was 1:0.75.

These prepared samples were developed in the same process as in Example 1.

The thus obtained samples, dividing each into two, were separately put in two desiccators: one whose inside was conditioned at a relative humidity of 10% at 40° C. (controlled by a saturated $ZnCl_2$ solution) and the other whose inside was conditioned at a relative humidity of 81% at 40° C. (controlled by a saturated $(NH_4)_2SO_2$ solution) and then exposed to the sunlight over a period of 20 days, and after that the dye discoloration degrees at the areas of unexposed density Do=1.0 of the samples were measured. The results are as shown in Table 3-2.

TABLE 3-2

| Sample No. | UV-absorbing agent | High-boiling solvent | Discoloration degree (40° C., 10% RH) Y | M | C | Discoloraton degree (40° C., 81% RH) Y | M | C |
|---|---|---|---|---|---|---|---|---|
| 65 | UV-B (control) | DBP (control) | 19 | 20 | 17 | 29 | 31 | 31 |
| 66 | | DOP | 19 | 20 | 16 | 29 | 30 | 32 |
| 67 | | TBP (control) | 18 | 19 | 16 | 30 | 31 | 32 |
| 68 | | TCP | 19 | 20 | 17 | 29 | 30 | 33 |
| 69 | UV-D (control) | DBP (control) | 19 | 19 | 16 | 30 | 31 | 31 |
| 70 | | DOP | 17 | 19 | 17 | 27 | 30 | 32 |
| 71 | | TBP (control) | 18 | 18 | 17 | 30 | 31 | 33 |
| 72 | | TCP | 17 | 19 | 17 | 28 | 29 | 32 |
| 73 | | DBP (control) | 17 | 19 | 16 | 24 | 27 | 29 |
| 74 | | DOP | 16 | 19 | 15 | 16 | 19 | 15 |

TABLE 3-2-continued

| Sample No. | UV-absorbing agent | High-boiling solvent | Discoloration degree (40° C., 10% RH) Y | M | C | Discoloraton degree (40° C., 81% RH) Y | M | C |
|---|---|---|---|---|---|---|---|---|
| (invention) 75 | UV-1 | TBP (control) | 17 | 18 | 16 | 26 | 28 | 30 |
| 76 (invention) | | TCP | 17 | 18 | 13 | 17 | 18 | 14 |
| 77 | | DBP (control) | 17 | 18 | 15 | 25 | 28 | 29 |
| 78 (invention) | | DOP | 16 | 17 | 15 | 16 | 17 | 15 |
| 79 | UV-4 | TBP (control) | 16 | 18 | 16 | 25 | 29 | 29 |
| 80 (invention) | | TCP | 16 | 18 | 14 | 16 | 18 | 15 |

We claim:

1. A color photographic light-sensitive material comprising, on a reflective support, (a) at least one light-sensitive silver halide emulsion layer, a cyan dye forming coupler being present in the light-sensitive silver halide emulsion layer if said material comprises only one emulsion layer or, if said material comprises more than one emulsion layer, said cyan dye-forming coupler being present in the emulsion layer located furthest from the support, (b) a non-light-sensitive layer provided on the opposite side, relative to the support, either of the light-sensitive silver halide emulsion layer containing the cyan dye-forming coupler if said material contains only one emulsion layer or, if said material contains more than one emulsion layer, of the light-sensitive silver halide emulsion layer containing the cyan dye-forming coupler located furthest from said reflective support, said non-light-sensitive layer containing;

(i) a benzotriazole derivative represented by the following Formula (I):

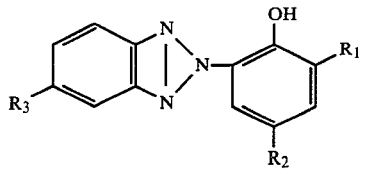

wherein $R_1$ and $R_2$ independently represent an alkyl, an alkoxy, an alkenyl, each alkyl, alkoxy, or alkenyl having not less than 4 carbon atoms, an aryl, or an aryloxy, said aryl and aryloxy each being substituted or unsubstituted and wherein $R_3$ represents hydrogen, a halogen, an alkyl, an alkoxy, an alkenyl, each alkyl, alkoxy, or alkenyl having not less than 4 carbon atoms, an aryl, or an aryloxy; and (ii) at least one compound selected from the group consisting of compounds of the formulae (II) and (III):

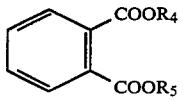

Formula (II)

wherein $R_4$ and $R_5$ independently represent an alkyl having not less than 5 carbon atoms, an aryl, or an aralkyl, said aryl and aryloxy each being substituted or unsubstituted;

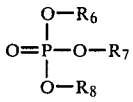

Formula (III)

wherein $R_6$, $R_7$ and $R_8$ independently represent an alkyl having not less than 5 carbon atoms.

2. A color photographic light-sensitive material according to claim 1, wherein $R_1$ and $R_2$ independently are an alkyl, an alkoxy, an alkenyl, each alkyl, alkoxy, or alkenyl having 4 to 8 carbon atoms or a substituted or unsubstituted phenyl or phenoxy; $R_4$ and $R_5$ independently are an alkyl having 5 to 16 carbon atoms, or a substituted or unsubstituted phenyl or benzyl; $R_6$, $R_7$ and $R_8$ independently are an alkyl having 5 to 16 carbon atoms.

3. A color photographic light-sensitive material according to claim 2, wherein said benzotriazole derivative is incorporated in said non-light-sensitive layer at a proportion from 0.001 to 2 parts by weight with respect to a binder used in said non-light-sensitive layer and the compound of Formula II and/or Formula III is incorporated in said non-light-sensitive layer at the proportion of 0.01 to 5 parts by weight with respect to said benzotriazole derivative.

4. A color photographic material according to claim 1, 2, or 3 wherein said light-sensitive silver halide emulsion layer consists of at least two silver halide emulsion layers each of which layers is sensitive to a different spectral region and each of which layers contains a different dye-forming coupler.

5. A color photographic material according to claim 1, wherein said non-light-sensitive layer is provided with another non-light-sensitive layer consisting essentially of a hydrophilic colloid.

6. A color photographic material according to claim 1, wherein $R_4$ and $R_5$ independently are an alkyl having 5 to 16 carbon atoms.

7. A color photographic material according to claim 1, wherein $R_4$ and $R_5$ independently are an alkyl having 8 to 12 carbon atoms.

8. The color photographic light-sensitive material of claim 1, wherein said material comprises more than one emulsion layer and at least one of the light-sensitive silver halide emulsion layers other than the furthest emulsion layer contains a magenta dye-forming coupler.

9. The color photographic light-sensitive material of claim 1, wherein said material comprises more than one emulsion layer and at least one of the light-sensitive silver halide emulsion layers other than the furthest emulsion layer contains a yellow dye-forming coupler.

10. The color photographic light-sensitive material of claim 1, wherein said material comprises more than one emulsion layer and at least one of the light-sensitive silver halide emulsion layers other than the furthest emulsion layer contains a yellow dye-forming coupler and is located closer to the support than the other emulsion layers, and wherein at least one of the light-sensitive silver halide emulsion layers other than either the furthest emulsion layer or the layer containing said yellow dye-forming coupler contains a magenta dye-forming coupler.

11. The color photographic light-sensitive material of claim 1, wherein said non-light-sensitive layer contains a benzotriazole derivative of Formula (I) and a compound of Formula (II).

* * * * *

UNITED STATES PATENT AND TRADEMARK OFFICE

CERTIFICATE OF CORRECTION

PATENT NO. : 4,540,656

DATED : September 10, 1985

INVENTOR(S) : Toyoki Nishizima; Masao Sasaki; Kaoru Onodera

It is certified that error appears in the above-identified patent and that said Letters Patent is hereby corrected as shown below:

Col. 15, line 29, "2nd layer" should read -- 6th layer --.

Col. 16, line 16, "2nd layer" should read -- 6th layer --.

Signed and Sealed this

*Twenty-fifth* Day of *March 1986*

[SEAL]

*Attest:*

DONALD J. QUIGG

*Attesting Officer*

*Commissioner of Patents and Trademarks*